United States Patent [19]

Hays

[11] 4,003,359

[45] Jan. 18, 1977

[54] FLUX WHEEL FOR BREAKERLESS DISTRIBUTOR RETROFIT

[76] Inventor: Bill J. Hays, 15112 Adams St., Midway City, Calif. 92655

[22] Filed: Feb. 11, 1974

[21] Appl. No.: 441,651

[52] U.S. Cl. ..... 123/146.5 A; 310/70 R; 200/19 M

[51] Int. Cl.[2] ..... F02P 1/00

[58] Field of Search ..... 123/148 E, 146.5 A, 123/148 DC; 310/76; 200/19 M, 19 DR

[56] References Cited

UNITED STATES PATENTS

| | | | |
|---|---|---|---|
| 2,864,967 | 12/1958 | Redick | 200/19 DR |
| 3,022,389 | 2/1962 | Wolrab | 123/146.5 A |
| 3,249,707 | 5/1966 | Johnson et al. | 200/19 M |
| 3,272,930 | 9/1966 | Frank | 200/19 M |
| 3,370,190 | 2/1968 | Neapolitakis | 123/148 E |
| 3,584,613 | 6/1971 | Kreil | 123/148 E |
| 3,647,995 | 3/1972 | Wisely | 123/146.5 A |
| 3,660,623 | 5/1972 | Bevaequa | 200/19 R |

*Primary Examiner*—Charles J. Myhre
*Assistant Examiner*—Ronald B. Cox
*Attorney, Agent, or Firm*—Fulwider, Patton, Rieber, Lee & Utecht

[57] ABSTRACT

There is disclosed pulse wheel means for fitting onto multi-lobe, breaker cams of automotive distributors to convert the distributors to a pointless or breakerless ignition system. The outer surface of such wheel means carries a plurality of upstanding, axial ribs which are equally spaced about the periphery of the wheel and which correspond in number to the number of lobes of the breaker cam, thereby forming a magnetic flux or magnetic pulse wheel for use with a magnetic field and voltage pulse generator useful in an ignition system for a multi-cylinder internal combustion engine. The wheel is formed of a metal having a high magnetic permeability, preferably by powdered metal technology wherein iron powders are molded and sintered into a cylindrical body having an axial through opening with a polygon cross-section and interior side walls generally conforming to the exterior surface of the cam. This construction provides a pulse wheel that is of a one-piece, integral construction with a very high magnetic permeability for insuring a maximum of induced voltages in the pick-up coil winding used with the pulse wheel. Additionally, the pulse wheel is in complete metal-to-metal contact with the breaker cam, thereby insuring a minimum of magnetic reluctance in the magnetic circuit used in the breakerless ignition system.

11 Claims, 10 Drawing Figures

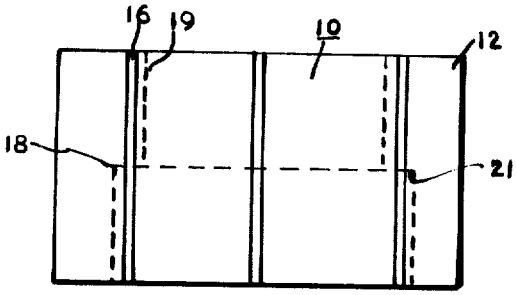
FIG. 1
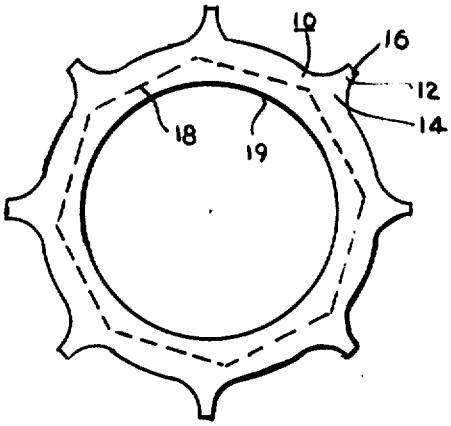
FIG. 2
FIG. 3
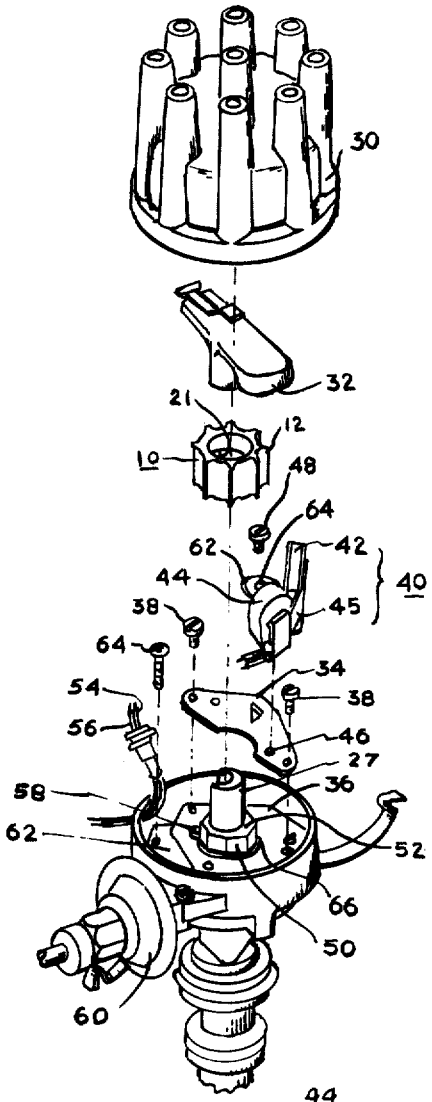
FIG. 8
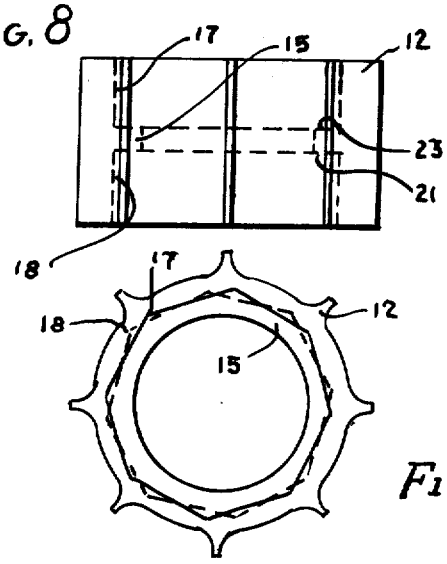
FIG. 9
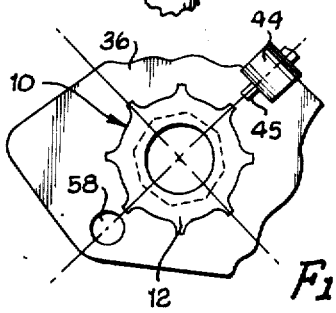
FIG. 3A

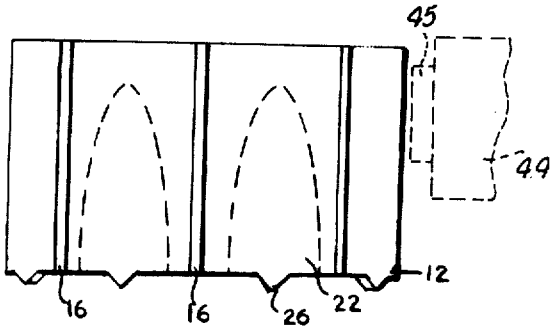
FIG. 4
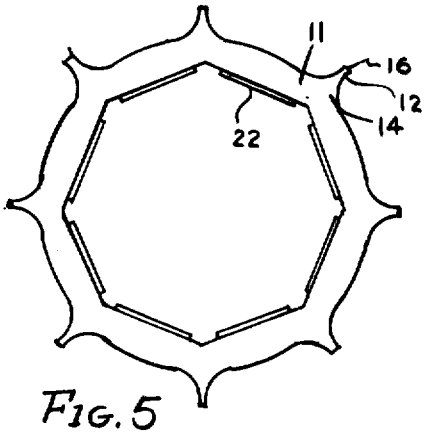
FIG. 5
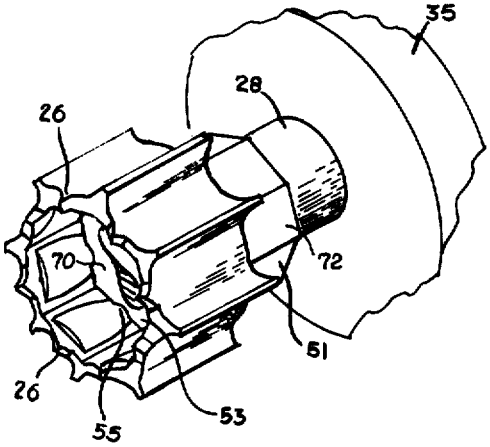
FIG. 6
FIG. 7
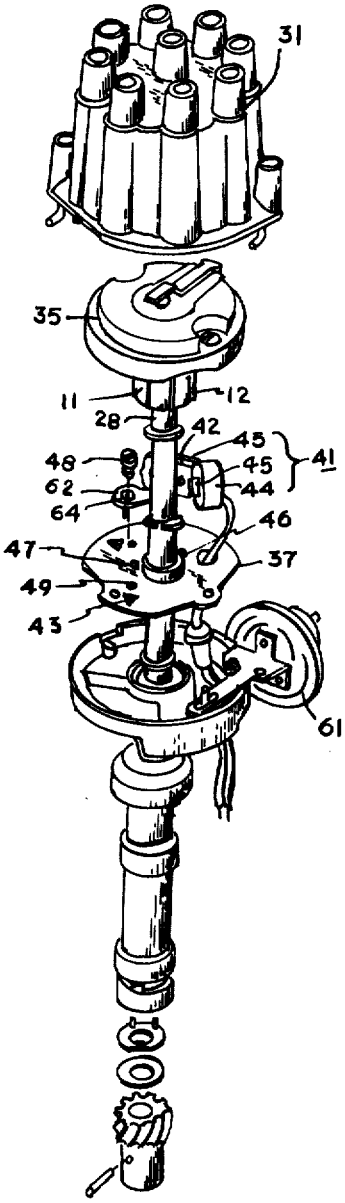

FLUX WHEEL FOR BREAKERLESS DISTRIBUTOR RETROFIT

This invention addresses itself to the problem of securely mounting the aforedescribed pulse wheel means onto the breaker cams of automotive distributors so as to retrofit breaker ignition systems to breakerless systems in a simple manner and without hindering access to the distributor parts for normal maintenance and adjustment. Two basic types of pulse wheels are disclosed which are suitable for retrofitting substantially all existing domestic automobiles to breakerless distributor systems. The first pulse wheel is intended for removable mounting on a cam and has axial stop and alignment means in the form of an annular shoulder about the interior surface of its polygonal through opening. This pulse wheel is intended for mounting on cams in a distributor having a mechanical advance mechanism located beneath the cam and is removably mounted on the cam to permit removal of the breaker or vacuum advance plate for servicing of the mechanical advance mechanism.

The second type of pulse wheel is intended for permanent mounting onto the surface of a cam for a distributor having the mechanical advance mechanism located above the cam. Retaining means are provided on the interior surface of the polygonal through opening of the wheel of this type whereby the wheel will be precisely indexed and rigidly secured to the hard and smooth surfaces of the breaker cam. The retaining means comprises a generally wedge-shaped protrusion on the surface of at least one, and preferably all, of the interior side walls of the through opening. As the wheel is pressed onto the cam, the entering edges of the multilobed cam will ride on the upper surface of the wedge-shaped protrusions, broaching off any excess material until, when the wheel is completely on the cam, the wheel will be secured thereto in an elastic and rigid engagement with the cam. The wheel is particularly adapted to be placed on cams having a slightly greater base, than top, diameter which are typically encountered in distributors having an upper centrifugal advance mechanism. In retrofitting the aforedescribed distributor to a breakerless system, the wheel must be placed over the cam moving in a base-to-top direction against the side wall taper of the cam. To permit the pulse wheel to be mounted on the aforedescribed cam, it is annealed to impart sufficient ductility to permit up to about one percent elastic elongation of the metal without encountering failure.

Both types of pulse wheels are furnished with means to retrofit distributors having clockwise or counterclockwise rotation.

BACKGROUND OF THE INVENTION

1. Field of the Invention

The invention relates to ignition systems for multicylindered, internal combustion engines and, in particular, to means for retrofitting a breaker-type ignition system to a breakerless system without replacement of the breaker cam and its associated mechanical linkage to the centrifugal advance mechanism customarily present in automotive distributors.

2. Description of the Prior Art

The breaker point system which has been commonly employed in the Kettering ignition systems of internal combustion engines has many serious operating defects. Since the breaker points are mechanically actuated, they can lose precise adjustment, i.e., become untuned, from wear and vibration. The points or contacts also wear and pit from electrical discharges as they are opened and closed. The opening and closing cycle also requires a finite period of time and systems for use with high speed engines have required the use of multiple sets of points and other encumbrances.

The increasing concern over environmental quality has aggravated the problems of the breaker point system. Minimum emissions of noxious gases such as nitrogen oxides, imcomplete combustion products, etc., can only be achieved when the ignition system is in precise adjustment. The degree of maladjustment of the breaker points in an ignition system which has, heretofore, been commonly tolerated is not acceptable when close control over emissions is desired. Additionally, energy is wasted by untuned engines. Frequent replacement of the breaker points and tuning of engines or the development of a substitute, breakerless ignition system is, therefore, required.

Various breakerless distributors and electronic ignition systems have been proposed and such systems are presently available as standard or optional equipment in the present new cars. The breakerless ignition systems which are available as original equipment, however, are not readily compatible with prior ignition systems and conversion of the ignition system of an older vehicle with such systems requires replacement of a number of expensive components of the ignition system.

Some attempts have been made to provide kits that can be used to retrofit breaker-type ignition systems to breakerless systems. These attempts have either employed the breaker cam of the existing ignition system directly as a magnetic pulse wheel, as in U.S. Pat. No. 3,291,108, and U.S. Pat. No. 3,328,614. These attempts have not been successful because the shape of a breaker cam prohibits the induction of a voltage pulse of sufficient magnitude in the pick-up coil of the ignition system, particularly at low engine speeds, to permit design of an entirely reliable ignition circuit.

Other investigators have suggested mounting pulse wheels or magnetic flux wheels onto the breaker cam of an ignition system to retrofit the latter to a breakerless system. Of these, U.S. Pat. No. 3,272,930 suggests that a spider of ferromagnetic segments be mounted onto a magnetically insulating sleeve or body and that the latter be placed over the breaker cam. This attempt could never provide a reliable ignition system and the failings of the aforedescribed patent are recognized in U.S. Pat. No. 3,249,707, which describes a magnetic pulse wheel that is formed from a plurality of laminations of alternating layers of a magnetically permeable metal and of a resilient metal for gripping onto the exterior surfaces of the distributor cam. The approach of this patent adds to the complexity of the retrofitting task and compromises the magnetic flux permeability of the pulse wheel by inadequate metal-to-metal contacting with the cam surfaces.

SUMMARY OF THE INVENTION

The invention provides a one-piece, integral pulse wheel for fitting onto a multi-lobed breaker cam of an automotive distributor to convert the distributor to a breakerless ignition system. The wheel is formed of a generally cylindrical body of a metal having a high magnetic permeability which, preferably, is formed by powdered metal technology. The wheel has an axial through opening with a polygonal cross-section and interior side walls which generally conform to the exterior surface of the cam. The outer surface of the wheel bears a plurality of upstanding, axial ribs which are equally spaced thereabout and which correspond in number to the number of lobes of the cam.

The breaker cams of most automotive distributors are permanently mounted on a shaft which extends to suitable mechanical, i.e., centrifugal, advance means. The two most common types of distributors have the mechanical advance mechanism positioned above or below the cam and each of these types poses particular problems for any successful retrofit system.

The type having the mechanical advance mechanism located beneath the cam, such as an Autolite distributor, require that the vacuum advance or breaker plate be removed over the cam for access to the mechanical advance system. With this type, the pulse wheel should be removably carried on the cam to permit removal of the breaker plate and particular design aspects of the pulse wheel for this distributor include means to index the pulse wheel accurately onto the cam without compromising the magnetic circuit characteristics of the pulse wheel.

The distributor type having the mechanical advance mechanism located above the cam presents another problem. The pulse wheel can be permanently mounted onto the cam of this distributor by suitable means such as by a press fit. The cams of these distributors, however, usually are formed with a greater base than top diameter, i.e., with slightly tapered side walls, with the sidewall taper opposing the direction of the press fitting. The pulse wheel designed for use with this type of distributor, therefore, must be particularly designed and constructed to permit its installation onto the cam in a simple step while yet providing a secure attachment without compromising the magnetic circuit characteristics of the pulse wheel.

The pulse wheel intended for use with the first of the aforementioned cams, i.e., that having a subjacent centrifugal advance means should have means permitting its removable engagement with the breaker cam with index means to insure precise alignment onto the cam. This is achieved by sizing the axial through opening of the wheel approximately 0.0005 to about 0.003 inch greater diameter and by providing an internal stop and alignment means on the interior surfaces of the opening. The stop and alignment means comprises a shoulder that extends over the upper portion of the wheel so that it overlies the breaker cam when the pulse wheel is placed on the cam. The undersurface of this shoulder is precisely machined to engage the machined upper surface of the cam and thereby insures that the wheel is precisely coaxial with the cam. The shoulder also serves as an axial stop to limit the travel of the wheel over the cam.

The pulse wheel intended for use with the cam of a distributor having an upper centrifugal advance mechanism bears retaining means on the inside surfaces of its through opening whereby the wheel can be securely locked onto the cam. The retaining means for securing this wheel on the breaker cam of a distributor comprise wedge-shaped protrusion means on the surface of at least one of the interior side walls, preferably on all of the interior side walls of the wheel. The aforedescribed wheel is press-fitted onto the breaker cam of the distributor and, during this press-fitting, the entering or base edges of the distributor cam will broach excessive or interfering metal from the inside surface of the wedge-shaped protrusion, thereby insuring a secure mounting of the wheel to the cam.

The aforedescribed pulse wheel means are preferably formed with powdered metal technology. In this forming, powders of iron or other metals having a high magnetic permeability are molded into the approximate shape desired for the wheel and the molded powders are sintered to obtain a high strength, integral body. The sintered, molded shapes are thereafter coined by high pressure, axial compression of the wheel in a die having the precise dimensions and shapes desired in the final product. During this coining operation, the desired wedge-shaped protrusions can be formed on the pulse wheels which are intended to be permanently attached to a breaker cam by a press-fitting installation.

When the wheel is manufactured and particularly intended for retrofitting of breaker cams which have a slightly greater base than top diameter and which, therefore, require that the wheel be press-fitted onto the cam against the taper of its exterior surfaces, the coined wheels are thereafter annealed. The annealing is performed by heating the wheels to an elevated temperature for a short period of time, which temperature and time are sufficient to impart sufficient ductility to the metal body to permit it to undergo at least about one percent elastic elongation without fracturing.

The retrofit kits with either pulse wheel have means to adapt to distributors having clockwise or counterclockwise rotation.

BRIEF DESCRIPTION OF THE DRAWINGS

The invention will be described by reference to the accompanying illustrations of which:

FIG. 1 is an elevation view of a pulse wheel of the invention;

FIG. 2 is a plan view of the pulse wheel of FIG. 1;

FIG. 3 illustrates the retrofitting of a distributor with the pulse wheel of FIGS. 1 and 2;

FIG. 3A is a plan view of the retrofitted distributor of FIG. 3.

FIG. 4 is an elevation view of another pulse wheel of the invention;

FIG. 5 is a plan view of the pulse wheel of FIG. 4;

FIG. 6 illustrates the mounting of a pulse wheel of FIGS. 4 and 5 onto a breaker cam;

FIG. 7 illustrates the assembly of a retrofitted distributor using the pulse wheel of FIGS. 4 and 5; and FIGS. 8 and 9 illustrate an alternative pulse wheel.

DESCRIPTION OF THE PREFERRED EMBODIMENTS

Referring now to FIGS. 1 and 2, the pulse wheel 10 can be seen to comprise an integral, one-piece body which is generally circular and which bears a plurality of upstanding axial ribs 12 spaced at equal increments about its outer periphery. The ribs 12 have a cross-section which is generally of a truncated triangular shape with a wide base portion 14 and a narrowly defined smooth outer edge 16. The number of ribs corresponds to the number of lobes of the cam on which the wheel is to be fitted; the cam is illustrated having eight upstanding ribs and thereby being intended for fitting onto an eight-lobed cam such as that employed for the ignition of an eight-cylinder internal combustion engine.

The interior of wheel 10 has an axial opening 18 which is polygonal in general cross-section and which conforms to the polygonal cross-section shape of the exterior surface of the cam on which the wheel is to be mounted. The diameter of opening 18 is sized approximately 0.0005 to 0.003 inch greater than that of the cam on which it is to be fitted to permit its manual placement onto and removal from the cam. The opening 18 does not extend the entire height of the cam body 10 but terminates therein at the upper portion of the body. A through opening 19 is provided through the upper extremities of the flux wheel 10. This through opening 19 is of lesser diameter than the polygonal opening 18 to provide a flat shoulder 21 about its undersurface. The shoulder 21 is formed to precise dimensions and is precisely perpendicular to the axis of the pulse wheel 10.

FIG. 3 illustrates a distributor retrofitted with the pulse wheel of FIGS. 1 and 2. In this installation, the distributor cap 30 and rotor 32 are removed. The conventional set of breaker points and ignition condenser are removed and discarded and a mounting plate 34 is attached to the vacuum advance plate 36 by screws 38.

A voltage pulse generator 40 comprising a magnetic field generating means (magnet 12 and pole piece 45) and a voltage pulse generator (coil 44 which is carried on one arm of pole piece 45) is attached to mounting plate 34 by a bracket 62 which has a base plate with an aperture to engage a boss 46 on plate 38 and a slot 64 for screw 48. The wire conductors 54 and 56 are passed through an aperture in the side wall of the distributor.

Pulse wheel 10 is placed over the breaker cam 50 of the distributor and shoulder 21 is placed into engagement with the machined upper flat surface 52 of the cam. Before assembly, the side walls of opening 18 can be coated with a thin film of a suitable adhesive such as a polyvinyl acetate emulsion to cement the wheel 10 securely to the cam 50. The rotor 32 and distributor cap 30 are replaced and the distributor is retrofitted for use in a breakerless ignition system.

As shown in FIG. 3, the centrifugal advance mechanism of the distributor is beneath the cam and is covered by the vacuum advance plate 36 which is pivotable about pin 58 by movement of a push rod that extends from the vacuum advance unit 60. As shown in FIG. 3A, this pivot point (pin 58) is off center from the distributor shaft 27. The pivoting of plate 36 will change the air gap between ribs 12 and the inward end of pole piece 45. The bracket 62 positions the end of pole piece 45 directly opposite from pivot pin 58 when no vacuum advance is present. This insures that the air gap spacing between ribs 12 and pole piece 45 will be minimal when starting the engine when the maximum induced voltage in coil winding is desired.

Servicing of the centrifugal advance mechanism, which is located within the distributor housing and beneath the vacuum advance plate 36 requires removal of plate 36 and its supporting subplate 62 by removing screws such as 64. The central apertures 66 of these plates is sized sufficiently large to permit them to be lifted from the distributor housing over cam 50. This manipulation is preserved in the retrofitted distributor by providing for the aforedescribed removable attachment of flux wheel 10 onto cam 50.

Referring now to FIGS. 4 and 5, the pulse wheel 11 there illustrated is seen to comprise an integral, one-piece body which is generally circular and which also bears a plurality of upstanding axial ribs 12 spaced at equal increments about its outer periphery. The ribs 12 have a cross-section which is generally of a truncated triangular shape with a wide base portion 14 and a narrowly defined smooth outer edge 16. The number of ribs corresponds to the number of lobes of the cam on which the wheel is to be fitted; the cam as illustrated having eight upstanding ribs and thereby being intended for fitting onto an eight-lobed cam such as that employed for the ignition of an eight-cylinder internal combustion engine.

The interior of wheel 11 has an axial through opening 19 which is polygonal in general cross-section and which conforms to the polygonal cross-section shape of the exterior surface of the cam on which the wheel is to be mounted. On one, and preferably on all, of the interior surfaces 20 of wheel 11 are suitable retaining means for securing the wheel 11 onto a breaker cam. As illustrated, the retaining means are of the form of generally wedge-shaped protrusions 22 on the interior side wall of the wheel. The wedge-like appearance of these protrusions 22 appears most graphically in FIG. 1. As illustrated in the drawings, the protrusions 22 are greatly exaggerated. In reality, these protrusions are apparent only by a slight refraction of the light as the wheel is held in an observer's hand. The maximum thickness of these protrusions, i.e., the thickness at the base 24 of the protrusion (FIG. 1), is from 0.001 to about 0.015 inch.

In its preferred embodiment, the base of the pulse wheel 11 bears a plurality of fingers 26 which are axial projections from the lower edge of the pulse wheel. These fingers provide raised points of contact for engagement by the installation tools used for press fitting of the pulse wheel onto the cam and thereby insure against damage to the operative outer surfaces of the pulse wheel.

As previously mentioned, the pulse wheel is intended for the retrofit installation on breaker cams, particularly on breaker cams which have a slightly greater base than top diameter and which are permanently mounted on a sleeve that extends from the upper end of the cam to a centrifugal advance mechanism, above the cam. The peculiar construction of the aforedescribed breaker cam and centrifugal advance mechanism dictates that any facile retrofitting of the cam to a breakerless system be accomplished by advancing the wheel 11 onto the cam from its base in a base-to-top direction, against the taper of the side walls of the cam. Generally, the base diameter of a conventional distributor cam of the aforedescribed type is about 0.001 inch greater than its top diameter.

FIG. 6 illustrates the press-fitting of the pulse wheel of this invention onto distributor cam 51 which is shaped with a base 70 having a greater diameter than top 72, as previously described. In such installations, the distributor shaft 28 is rigidly secured in a vise or the like and a tool such as a sleeve is placed with its forward edge abutting against fingers 26 of pulse wheel 11. A force is applied to the sleeve to advance the cam over the base edge 53 of the cam and to slowly advance the wheel onto the cam in the illustrated manner. As the cam enters the pulse wheel, the base edges 53 will engage against the interior surface of axial protrusions 22. The body of wheel 11 is of a sufficiently ductile metal as to permit at least about one percent elastic elongation thereof without fracturing so the wheel can expand sufficiently to permit it to pass over the larger diameter base of cam 51. As the pulse wheel 11 is advanced onto cam 51, the base edges 53 will broach any excess material 55 from the innermost surface of protrusion 22, thereby insuring a tight and resilient adherence of the pulse wheel to the outer surfaces of the cam 51.

The wedge-shaped protrusions 22 also provide means to accommodate for the manufacturer's tolerances in dimensions of the cams. Frequently, cams are encountered which have been manufactured with rather loose manufacturing controls or large manufacturing tolerances. Consequently, it is common to encounter cams of the same make and model distributors which have dimensional variances as great as plus or minus 0.02 inch. This imprecise dimensioning of conventional breaker cams requires the provision of retaining means in a pulse wheel which can accommodate such variance without compromising the magnetic flux characteristics or the mechanical strength and attachment of the pulse wheel to the cam.

FIG. 7 illustrates the manner in which the pulse wheel of the invention is employed in a retrofitted distributor. As illustrated in FIG. 6, the pulse wheel 11 is press-fitted onto the cam and the resultant assembly of the distributor shaft 28, cam and its coaxial pulse wheel 51 and centrifugal advance mechanism 35 is reinstalled in the otherwise conventional distributor. The breaker points and condenser normally carried on the vacuum advance plate 37 of the distributor are removed and replaced by a voltage pulse generator 41. This voltage pulse generator includes a magnetic field generating means such as permanent magnet 42 and a magnetically permeable pole piece 45 having one leg thereof which is radially directed towards the pulse wheel to be in planar alignment with the ribs 12 of this pulse wheel 11 as the pulse wheel is rotated. A coil winding 44 is mounted on leg 60 of the pole piece, which thereby serves to conduct magnetic flux through the interior of the coil winding. The entire assembly is mounted onto the vacuum advance plate 37 of the distributor by an upright leg of bracket 62, which has a base portion which can be secured to the vacuum advance plate 37 by machine screw 48 through slot 64 of the bracket, and boss 46 which is on the vacuum advance plate and which engages an aperture in the base of bracket 62 in the illustrated manner.

The assembly of the pulse wheel with its wedge-shaped protrusions 22 over cam 51 with its substantially larger base diameter, can induce a slight outward deformation of the lowermost portions of ribs 12. Such outwardly deformation can interfere with the inward edge of leg 60 of the pole piece when suitable close tolerances are provided between the pole piece and ribs 12 of the flux wheel. Typically, it is desired to have an air gap between these elements from 0.001 to about 0.003 inch to insure that a maximum of induced voltages surges is generated in coil winding 61. Accordingly, the pole piece is sized of slightly lesser width than the height of the upstanding ribs 12 of wheel 11 and is supported by bracket 62 so that it is opposite the upper portion of these ribs. This is illustrated in FIG. 4 where the portion of the pole piece 60 relative to wheel 11 is shown by broken lines to be opposite the uppermost half to two-thirds the height of ribs 12 so as to provide the desirable close tolerances without encountering any objectional interference.

The pulse wheels employed in the invention are preferably formed using powdered metal technology. In this manufacture, metal powders which are suitably subdivided, e.g., passing about a 100 mesh screen. A typical screen analysis of suitably sized iron powders would be approximately one-third weight fraction passing a 200 mesh screen, one-third weight fraction retained on a 250 but passing a 150 mesh screen and one-third retained on a 150 but passing a 40 mesh screen. These finely subdivided powders are compacted into a "green" shape by loading the powders into a suitable die together with a minor amount of a lubricant such as zinc stearate, and applying thereto a pressure of from 30 to about 40 tons per square inch. The resultant, compacted body is thereafter sintered, typically at atmospheric pressure and a temperature from 1800° to 2200° F., typically 2050° F., for a short period of time, typically about 15 minutes, in an inert atmosphere such as hydrogen. The sintered body is then cooled to ambient temperatures and is dipped in a lubricant for coining.

The coining of the sintered body comprises compressing of the body while it is held in a finished mold having an intaglio pattern of the desired final shape. When forming the pulse wheels of the invention, this coining operation would employ a mold having die faces bearing an intaglio pattern of the protrusions 22 desired on the interior flat surfaces of the wheel. The coining is achieved on these wheels by the application of an axial pressure thereto which is sufficient to reduce the height of the wheels approximately 10 percent and increase proportionally the density and magnetic properties of the pulse wheel. Generally the density of the unsintered shape is about 6.5 grams per cubic centimeter and this density is increased to a value of about 7–7.3 grams per cubic centimeter by the coining operation. The pressures applied in the coining steps are from about 30 to about 55, typically from about 40–50 tons per square inch.

The coining of the sintered powders comprises a cold working which generally imparts some brittleness to the product. It is, therefore, desirable to anneal the coined pulse wheels to impart ductility thereto. Such annealing is essential when the pulse wheels are to be applied over a cam having a larger diameter base and thereby requiring an elastic deformation of the pulse wheel when it is pressed onto the cam. The annealing can be conducted at a temperature from 1600° to about 2000° F. at atmospheric pressure and, preferably, is performed in a hydrogen atmosphere. This annealing is performed in a period of time from 5 to about 25 minutes, preferably from 10 to about 15 minutes, to impart a sufficient ductility to the pulse wheels which permits approximately one percent elastic elongation of the metal. The latter degree of elongation is the amount that typically is required for application of the pulse wheels over a conventional cam which has an outer circumference of about three inches and approximately 0.01 inch greater base diameter than top diameter.

The metals of high magnetic permeability referred to herein are ferrous metal, including iron and carbon and stainless steels. Preferably, the so-called "soft" magnetic metals are used. Examples of these are iron and alloys thereof with major amounts of nickel and, optionally, lesser amounts of molybdenum, silicon, chromium, aluminum, e.g., Permalloy, MoPermalloy, Supermalloy, Monimax, Sinimax, Numetal, Deltamax, Isoperm, Conpernik, Perminval, etc.

The retrofit kits are also supplied with means to adapt to distributors having clockwise or counterclockwise rotation. FIGS. 8 and 9 illustrate a pulse wheel which incorporates such adapting means. This pulse wheel is formed with two axial openings, 18 and 17, which are polygonal in cross-section and which conform to the cross-sectional shape of the exterior surfaces of the cams on which the wheel can be seen to fit the high edges of the cams at a slight counterclockwise angle, e.g. from 3° to about 15°, from the associated rib 12. Opening 17, which extends into the pulse wheel from its opposite face, has its apexes at a similar clockwise angle from ribs 12. As shown, the wheel can be fitted onto a cam with opening 18 for counterclockwise rotation. The wheel can be inverted and fitted over a cam with opening 17 for clockwise rotation.

Openings 18 and 17 do not intersect, but, preferably, are separated by an annular rib 15 which provides shoulders 21 and 23 that will bear against the flat, machined upper surface of the cam and thereby precisely index the wheel to the cam.

An alternative means to adapt the retrofit kits for mounting in distributors with either counterclockwise or clockwise rotation is illustrated by vacuum advance plate 37. This is a replacement plate for that present in a conventional breaker-type ignition system. This plate carries boss 46 and a tapped bore to receive screw 48, previously described to mount the voltage pulse generator 41 in the illustrated position for clockwise rotation. A second boss 47 and associated tapped bore 49 are provided at about 80° – 155° counterclockwise angle therefrom to provide a second mounting position for the voltage pulse generator 41 for distributors having counterclockwise rotation. Each set of boss and tapped bore also has associated therewith a triangular slot 43 which receives a pin carried on the undersurface of bracket 62 to aid in orienting the voltage pulse generator on the plate 37.

The invention has been described with regard to the presently preferred and illustrated embodiment. It is not intended that this description of the invention be unduly limiting thereof. Instead, it is intended that the invention be defined by the means, and their obvious equivalents, set forth in the following claims.

I claim:

1. In a distributor of an internal combustion engine having multiple combustion chambers, which distributor receives a distributor shaft bearing a cam having a number of lobes evenly spaced thereon corresponding to the number of said combustion chambers, a breaker plate mounted beneath said cam and rotatable about said distributor shaft and supporting an induced voltage coil and magnetic assembly, the improvement which comprises:

a pulse wheel comprising a one-piece, integral, generally cylindrical body of a ferro-magnetic metal having an axial through opening with a polygonal cross-section and interior side walls generally conforming to the exterior surfaces of said cam; a plurality, corresponding in number to the number of lobes of said cam, of upstanding axial ribs equally spaced about the periphery of said wheel; and retaining means for securely supporting said wheel on said cam in the form of a continuous wedge-shaped inward protrusion integral with and substantially coextensive with at least one of said interior side walls rigidly secured to and carried on said cam with said wedge-shaped protrusion being press-fitted into binding engagement with and broached by the exterior side surfaces of said cam.

2. The distributor of claim 1 wherein said cam has a greater base than top diameter and wherein said end of said arm of said magnetic assembly has a width of lesser dimension than the height of the upstanding ribs of said pulse wheel and is mounted on said breaker plate at a height to be positioned opposite the upper approximately two-thirds portions of said ribs, whereby any outward distortions in imparted to said wheel by said cam do not cause interference between said ribs and said end of said arm.

3. The wheel of claim 1 wherein said wedge-shaped protrusions are on surfaces of all said interior side walls.

4. The wheel of claim 3 wherein said wedge-shaped protrusions increase in thickness at the base of said wheel and said wheel is press-fitted onto a multi-mold breaker cam having a greater base than top diameter.

5. The wheel of claim 4 wherein said body is formed of a malleable metal having sufficient ductility to permit up to about one percent elastic elongation without fracture whereby said wheel can be press-fitted onto said cam in a base-to-top movement.

6. The wheel of claim 5 wherein said body is formed of sintered, compacted iron powders.

7. The wheel of claim 6 wherein said body of sintered, compacted iron powders is coined by pressing in a die at a pressure of from 35–65 tons per square inch and is thereafter anealed to impart sufficient ductility thereto to permit up to about one percent elongation of said body without fracture.

8. In a retrofitted distributor of an internal combustion engine having multiple combustion chambers, which distributor receives a distributor shaft bearing a cam having a number of lobes evenly spaced thereon corresponding to the number of said combustion chambers, a breaker plate pivotally mounted beneath said cam between advance and no-advance positions about a pivot point which is off-center of said distributor shaft, timing advance means operatively connected to pivot said breaker plate between said advance and no advance positions whereby the angular relationship between said cam and breaker plate is variably adjustable in response to varying engine load, a pulse wheel removably mounted onto said cam and comprising a generally cylindrical, one-piece, integral body of a ferromagnetic metal having an axial opening with a polygonal cross-section and interior side walls generally conforming to the exterior surface of said cam, the improvement which comprises: a magnetic assembly comprising: bracket means having a base plate portion carried on said breaker plate and an upright leg; magnetic field source means supported by said upright leg; an arm extending from said magnetic field source means and terminating with an end projecting radially towards the center line of said shaft and in proximity to the edge surfaces of said ribs and directly in line with said pivot point of said breaker plate and center of said distributor shaft when said breaker plate is in its no-advance position; and a coil surrounding a portion of said arm with electrical conductor means leading therefrom; whereby a magnetic circuit for flux is established from said magnetic field source through said arm, said magnetic flux wheel, said cam, and the path of least magnetic reluctance through said distributor to said magnetic field source means.

9. The retrofitted distributor of claim 8, wherein said improvement also includes as said pulse wheel said cylindrical integral body having said axial opening into but not there through with a coaxial bore of lesser diameter that said opening and extending from the upper face of said wheel into said opening to provide an annular shoulder therein which seats onto the upper surface of said cam, thereby centering said wheel precisely on said cam.

10. The retrofitted distributor of claim 9 wherein said pulse wheel is formed of sintered, compacted iron powder.

11. The retrofitted distributor of claim 10 wherein said wheel of sintered, compacted iron powders is prepared by pressing, axially, in a die at pressure from 35 to 65 tons per square inch.

* * * * *